United States Patent [19]

Wataya

[11] Patent Number: 4,706,631

[45] Date of Patent: Nov. 17, 1987

[54] FUEL INJECTION CONTROL SYSTEM FOR INTERNAL COMBUSTION ENGINE

[75] Inventor: Seiji Wataya, Hyogo, Japan

[73] Assignee: Mitsubishi Denki Kabushiki Kaisha, Tokyo, Japan

[21] Appl. No.: 914,403

[22] Filed: Oct. 2, 1986

[30] Foreign Application Priority Data

Oct. 2, 1985 [JP] Japan ..... 60-218138

[51] Int. Cl.[4] ..... F02D 41/18

[52] U.S. Cl. ..... 123/488; 123/486; 123/494; 73/118.2

[58] Field of Search ..... 123/488, 494, 486, 478; 73/118.2

[56] References Cited

U.S. PATENT DOCUMENTS

| | | | |
|---|---|---|---|
| 3,818,877 | 6/1974 | Barrera et al. | 123/494 |
| 4,217,863 | 8/1980 | Ezoe | 123/494 |
| 4,275,695 | 6/1981 | Bauer et al. | 123/486 |
| 4,594,987 | 6/1986 | Wataya et al. | 123/494 |

*Primary Examiner*—Andrew M. Dolinar

*Attorney, Agent, or Firm*—Sughrue, Mion, Zinn, Macpeak, and Seas

[57] ABSTRACT

A fuel injection control system intended to correct for return blow. First, the sensed throttle valve opening is corrected according to the engine'rotation rate to provide a correction factor. Then this correction factor is combined with a sensed air-flow signal and an air temperature signal to provide a corrected air-flow amount.

5 Claims, 8 Drawing Figures

FUEL INJECTION CONTROL SYSTEM FOR INTERNAL COMBUSTION ENGINE

BACKGROUND OF THE INVENTION

Field of the Invention

This invention relates to a fuel injection control apparatus for an internal combustion engine of a car, and particularly to such a control apparatus which processes measured values of the quantity of suction air in the internal combustion engine.

BACKGROUND OF THE INVENTION

FIG. 1 illustrates a previously known fuel injection control apparatus for an internal combustion engine of the kind described above. Referring to FIG. 1, the numeral 1 designates an internal combustion engine. An electromagnetically driven injector (fuel injection valve) 2 supplies fuel to the internal combustion engine 1. A hot-wire air-flow sensor 3 detects the quantity of air sucked into the engine. A throttle valve 5 within a suction pipe 6 regulates the quantity of air sucked into the engine 1. A water temperature sensor 7 detects the temperature of the engine. A controller 8 computes the quantity of fuel to be supplied to the engine on the basis of an air quantity signal supplied from the air-flow sensor 3 and then applies a pulse having a width corresponding to the required fuel quantity to the injector 2. Further, an igniter 9 generates a pulse signal for the controller 8 at a predetermined rotational angle of the engine during each engine revolution. Also shown in FIG. 1 is a fuel tank 11. A fuel pump 12 applies pressure to the fuel in the tank 11. A fuel pressure regulator 13 maintains the fuel pressure to the injector 2 constant. Finally, there is shown an exhaust pipe 14. The controller 8 includes an input interface circuit 80, a microprocessor 81 and a ROM 82. The microprocessor 81 is arranged to process various kinds of input signals, to compute the quantity of fuel to be supplied through the suction pipe 6 to the combustion chamber as determined by the execution of a predetermined program stored in advance in the ROM 82, and to control a drive signal to the injector 2. A RAM 83 of the controller 8 temporarily stores data as the microprocessor 81 executes computations. An output interface circuit 84 of the controller drives the injector 2.

The conventional engine control apparatus operates as follows. The quantity of fuel to be supplied to the engine is calculated by the controller 8 on the basis of a suction air quantity signal detected by the air flow sensor 3. At the same time, the rotational frequency of the engine is calculated on the basis of a rotation pulse frequency obtained from the igniter 9, so that a fuel quantity per engine revolution can be calculated. The controller 8 applies a required pulse width to the injector 2 in synchronism with an ignition pulse. The pulse width applied to the injector 2 is corrected so as to be increased or decreased in accordance with a temperature signal generated from the water temperature sensor 7 because it is necessary to set the required air/fuel ratio of the engine to the rich side when the temperature of the engine is low. Further, the air/fuel ratio is made richer upon detecting engine acceleration by monitoring the opening of the throttle valve 5.

In the conventional apparatus as described above the use of the hot-wire air-flow sensor 3 makes it unnecessary to include means for correcting atmospheric pressure. This is so because the sensor 3 can detect the quantity of suction air by weight. However, the sensor 3 is sensitive to the return blow of air produced by valve overlapping of the engine so that it may detect a signal representing a quantity of suction air in which the quantity of the return-blow air is also included. Accordingly, the output signal generated by the air-flow sensor 3 may express a quantity of suction air which is larger than the actual quantity of the suction air. Return blow is apt to occur during low-speed, full-power operation of the engine. For example, as illustrated in FIG. 2, although the true suction air is not sucked during time $t_R$, the measured suction air quantity has a wave form as shown in FIG. 2, which would seem to indicate that the suction air is increased by the return blow. As the result, the output of the air-flow sensor 3 expresses values, as shown in FIG. 3, considerably larger than the true values (shown by broken lines in the drawing), in the low-speed, full-power region. Although varying with the layout of the engine, the suction system, or the like, the error due to the return blow generally reaches a maximum of about 50% so that use of the sensor 3 as illustrated in FIG. 1 is not practical.

In order to compensate for such an error, there has been proposed a method in which values for the maximum quantity of suction air (including variations) to be sucked into the engine are stored in the ROM 82. As a result, as shown in FIG. 4, the output signal a generated from the air-flow sensor 3 is disregarded and clipped to a line of values as shown by "MAX" which are slightly larger (for example, 10%) than an average value b of the true suction air quantity. In this method, however, the clipping values represented by "MAX" imply that the maximum suction air quantity is set for engine operating conditions at sea level and at an ordinary temperature. Accordingly, the air/fuel ratio is greatly shifted to the rich side when the engine is operating at low atmospheric pressure at high altitudes or where the suction air temperature is high, increased fuel cost as well as the possibility of an accidental fire. Further, there is the corresponding problem that the air/fuel ratio is shifted to the lean side when the temperature of the suction air is low.

There also has been proposed a method in which wave forms affected by return blow are first determined and are then subjected to subtraction to thereby correct a detection error in a air-flow sensor 3 due to such return blow of suction air. However, the waveforms due to the return blow vary depending on both the rotational frequency of the engine and the opening of the throttle valve. Accordingly, it has been impossible to perform accurate correction.

Thus, with the conventional fuel injection control apparatus, there exists the problem that the hot-wire air-flow sensor 3 detects the suction air quantity as a value larger than the true value thereof because of the return blow of air produced during low-speed, full-power operation, so that the air/fuel ratio cannot be properly controlled over a certain running region.

SUMMARY OF THE INVENTION

An object of the present invention is to solve the above-discussed problems.

A more specific object of the invention is to provide a fuel injection control apparatus for an internal combustion engine arranged to obtain an appropriate air/fuel ratio by correcting the output of a hot-wire air-flow sensor in accordance with to the rotational frequency of the engine, the opening of a throttle valve, and the temperature of the suction air, even during low-speed, full-power running when return blow is generated.

The fuel injection control system for an internal combustion engine according to this invention corrects the output signal of an air-flow sensor in the return blow operating region of the engine by making a first insertion according to a correction factor calculated on the basis of both the opening of a throttle valve for regulating the quantity of suction air and the rotational frequency of the engine. Then, a further correction is made to the corrected output signal by correcting on the basis of the temperature of the suction air. Finally fuel injection quantity is determined on the basis of the signal of the doubly corrected suction air quantity.

BRIEF DESCRIPTION OF THE DRAWINGS

In the drawings, the same numeral designates the same or like part.

DETAILED DESCRIPTION OF THE PREFERRED EMBODIMENTS

In determining the fuel injection quantity on the basis of the output signal of a hot-wire air-flow sensor, the control system according to the present invention operates to correct the output signal of the hot-wire air-flow sensor by using a correction factor calculated on the basis of both the opening of a throttle valve and the rotational frequency of the engine. The control system then further corrects the corrected output signal of the air-flow sensor on the basis of the change of the air quantity depending on the temperature of the suction air, and determines the fuel injection quantity on the basis of the corrected suction air quantity output signal.

Figure 1:
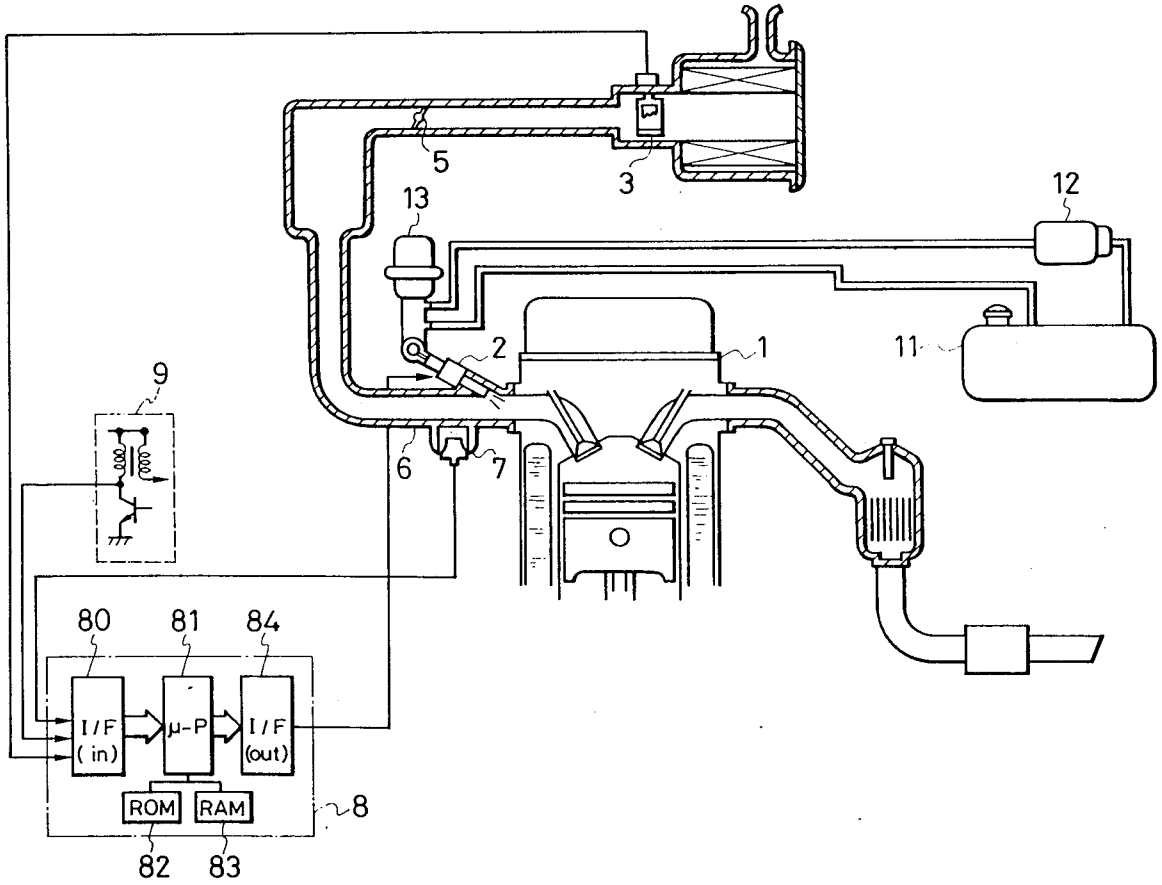
FIG. 1 PRIOR ART
FIG. 1 is a schematic view partly in section, of a conventional fuel injection control system for an internal combustion engine.
Figure 2:
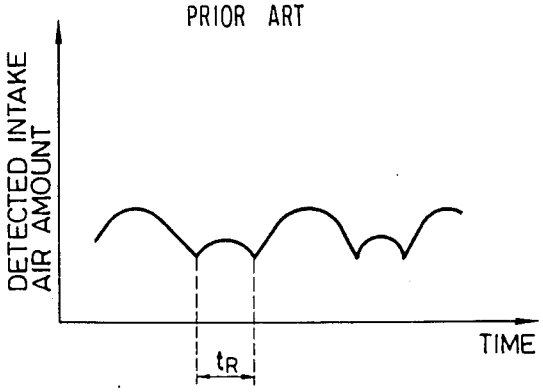
FIG. 2 PRIOR ART
FIG. 2 is a graph of waveform of the air-flow sensor of FIG. 1.
Figure 3:
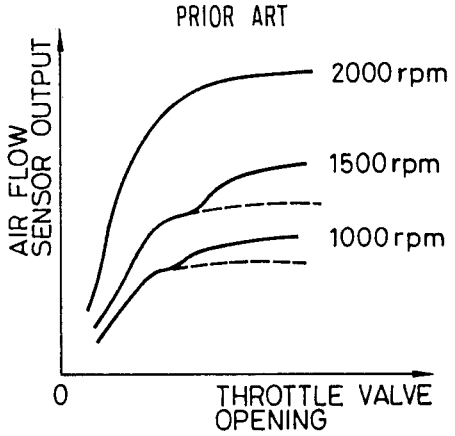
FIG. 3 PRIOR ART
FIG. 3 is a characteristic graph of the air-flow sensor of FIG. 1.
Figure 4:
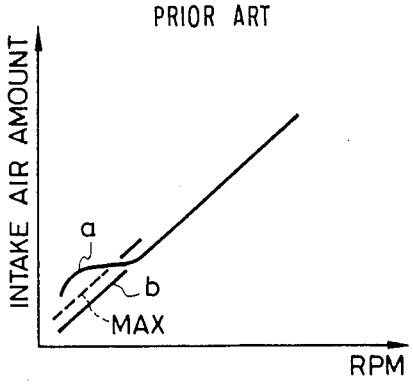
FIG. 4 PRIOR ART
FIG. 4 is a characteristic graph of the suction air quantity of FIG. 1.
Figure 5:
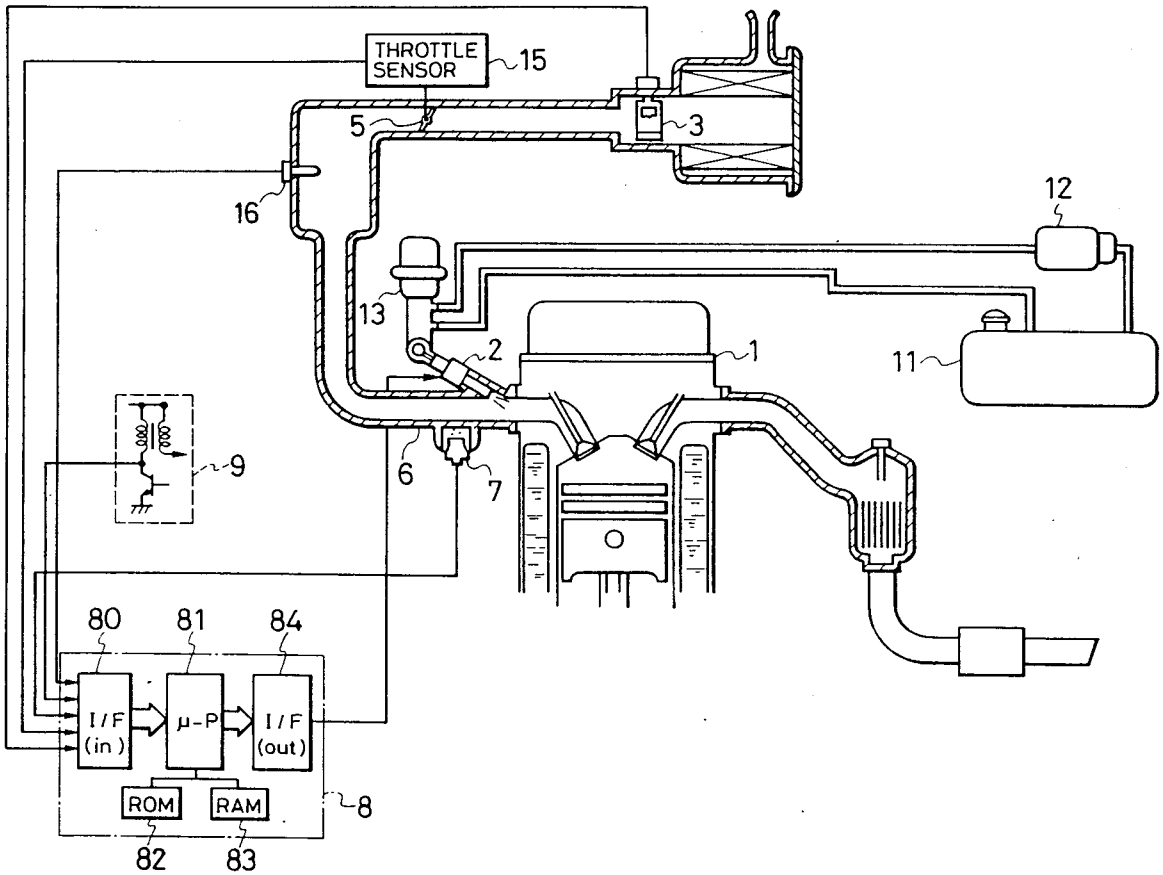
FIG. 5 is a schematic view partly in section, of a fuel injection control system for an internal combusion engine in accordance with an embodiment of the present invention.

An embodiment of the present invention will be described hereunder with reference to the drawings of FIGS. 5–8. In FIG. 5, which is slightly modified from the fuel injection control system of FIG. 1, an opening sensor 15 constructed of a variable resistor, and so on, detects the opening of the throttle valve 5. A suction air temperature sensor 16 provided in the suction pipe 6 detects the temperature of the suction air. Both the sensors 15 and 16 supply their respective outputs to the controller 8. Other like parts in FIGS. 1 and 5 are identified by the same reference numerals to avoid duplication or description.

Figure 6:
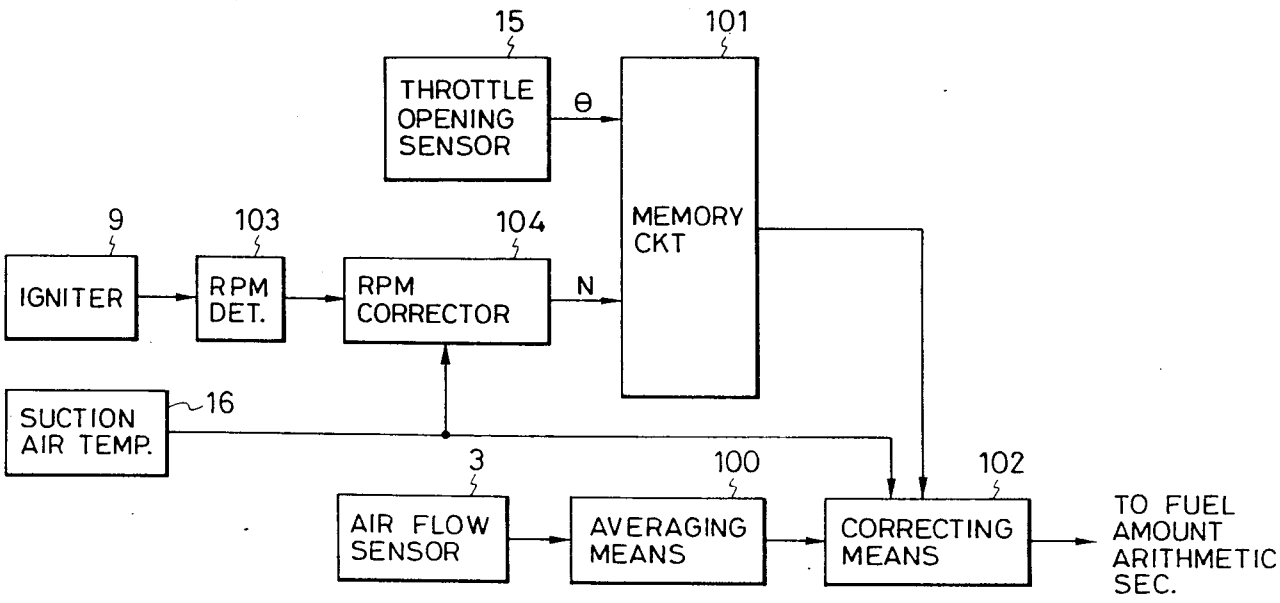
FIG. 6 is a diagram of a correcting circuit showing an embodiment of the present invention.

The operation of the system will now be described. The computation of fuel consumption in the region where return blow does not occur is made by the controller 8 in the same manner as described above with reference to the prior art. In the region of the occurrence of return blow, correction is made by the correcting circuit illustrated of FIG. 6. In FIG. 6 a rotational frequency detecting means 103 detects the rotational frequency of the engine on the basis of the pulse signal of the igniter 9. A rotational frequency correcting means 104 corrects the rotational frequency supplied from the rotational frequency detecting means 103 on the basis of the suction air temperature detected by the suction air temperature sensor 16.

Figure 7:
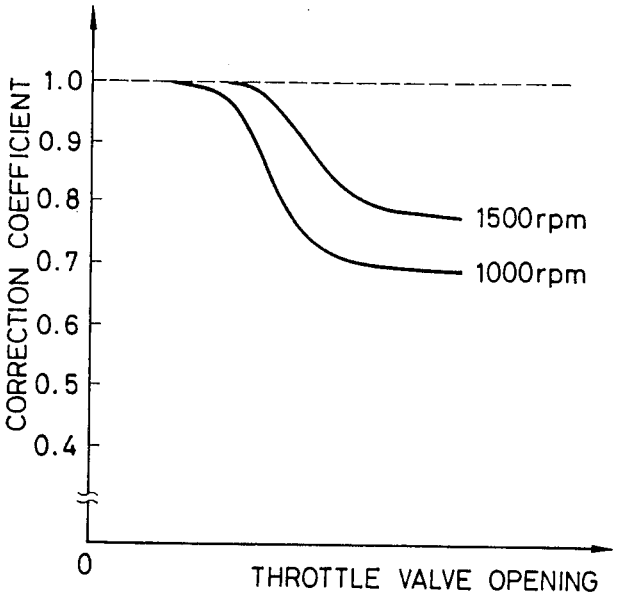
FIG. 7 is a characteristic graph of the correction factor of the correcting circuit of FIG. 6.

Various values of a correction factor are stored in a memory circuit 101 as a map corresponding to both the data of the throttle valve opening supplied from the throttle opening sensor 15 and the corrected rotational frequency of the engine supplied from the rotational frequency correcting means 104. Examples of such data pre-stored in the memory circuit 101 are shown in FIG. 7.

An averaging means 100 averages over a short period the output value (or in other words the mass-flow value) of the air-flow sensor 3 which pulsates over this short period. A correcting means 102 corrects the output signal of the averaging means 100 corresponding to both the correction factor of the memory circuit 101, and the output signal of the suction air temperature sensor 16. As a result, the air flow sensor 3 error in the return blow region can be corrected by multiplying the average output of the air-flow sensor 3 by the correction factor.

Although the above-mentioned correcting method is fully effective under the condition of a predetermined suction air temperature, the sound speed changes with temperature changes in the suction air to thereby vary the error characteristic of the air-flow sensor 3 due to the return blow.

Figure 8:
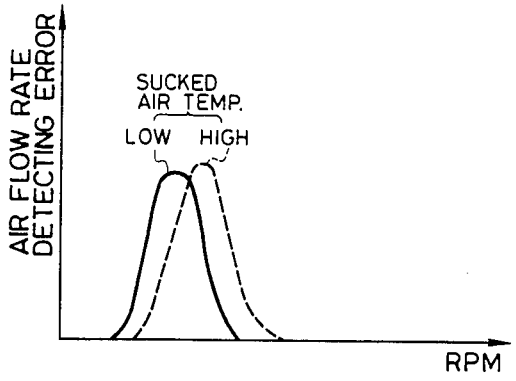
FIG. 8 is a characteristic graph of air quantity detection error rate.

According to the present invention, therefore, in order to both eliminate the fluctuations in detection error rate due to the return blow, produced by the change in the velocity of the air (which occurs in proportion to the square root of the absolute temperature) which is caused by the change in temperature of suction air, and to eliminate the fluctuations in detection error rate due to a deviation of the inertial overfeeding characteristic relative to the rotational frequency produced by the change in sound speed as shown in FIG. 8, the temperature of the suction air is detected by the suction air temperature sensor 16 to suppress the fluctuations in air quantity due to the temperature of suction air to thereby improve the accuracy in correction of the fuel supply quantity, that is, the fuel injection quantity. In other words, the higher the suction air temperature becomes, the more the rotational frequency producing a peak of inertial overfeeding is shifted to a higher rotational frequency. Accordingly, the actual rotational frequency is corrected in proportion the square root of the suction air temperature (absolute temperature) to thereby improve the reading. Furthermore, in order to suppress the fluctuations in suction air quantity detection error rate due to the change in sound speed, as the suction air temperature becomes higher, the correction factor corresponds in a predetermined way to both the opening of the throttle valve 5 as shown in FIG. 8 and the rotational frequency and is thus corrected to the lower side.

As described above, the system according to the present invention includes an opening sensor for detecting the opening of a throttle valve and a suction air temperature sensor for detecting the temperature of suction air. The system corrects the output signal of the air-flow sensor in the return blow region to reduce the output signal by using a correction factor predetermined in accordance with both the rotational frequency of the engine and the opening of the throttle valve which are in accordance with the characteristics of the engine. The system further corrects the output error of the air-flow sensor due to the change in air quantity depending on the suction air temperature. Accordingly, control of fuel supply using a hot-wire air-flow sensor can be accurate over the entire running region of the engine including the low-speed, full-power condition, and a proper air/fuel ratio can be provided in all running conditions. Furthermore, because the detection value is controlled when the engine is running at high altitudes and thus low atmospheric pressure as well as at sea level the present invention has the effect of providing a fuel injection control system for an internal combustion engine which is greatly superior for significant errors produced in the prior art system are not produced by the apparatus of the invention.

What is claimed is:

1. A fuel injector control apparatus comprising:

an air-flow sensor for detecting a quantity of suction air supplied to an internal combustion engine;

an injector for injecting fuel into said engine;

a controller for controlling a quantity of said injected fuel responsive to an output of said air-flow sensor;

a throttle valve for regulating the quantity of said suction air;

throttle valve opening detecting means for detecting the opening of said throttle valve;

rotational frequency detecting means for detecting the rotational frequency of said engine;

means for measuring the temperature of said suction air;

first correcting means responsive to outputs of said throttle valve opening detecting means and said rotational frequency detecting means for correcting said output of said air-flow sensor in a return blow region of said engine;

second correcting means responsive to outputs of said first correcting means and of said temperature measuring means for further correcting said output of said air-flow sensor;

means responsive to an output of said second correcting means for determining the quantity of said injected fuel.

2. A fuel injection control system as recited in claim 1, wherein said air-flow sensor is a hot-wire air-flow sensor.

3. A fuel injection control system as recited in claim 1, further comprising third correcting means responsive to said temperature measuring means for correcting said rotational frequency.

4. A fuel injection control system as recited in claim 1, wherein said first correcting means corrects said output of said air-flow sensor according to a correction factor selected from a map in a memory of said first correcting means according to said outputs of said throttle valve opening detecting means and said rotational frequency detecting means.

5. A fuel injection control system as recited in claim 3, wherein said third correcting means corrects said rotational frequency in proportion to the square root of the absolute temperature of said suction air.

* * * * *